US009776429B2

(12) United States Patent
Saito

(10) Patent No.: US 9,776,429 B2
(45) Date of Patent: Oct. 3, 2017

(54) PRINTING DEVICE

(71) Applicant: RISO KAGAKU CORPORATION, Tokyo (JP)

(72) Inventor: Tetsunori Saito, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/390,946

(22) Filed: Dec. 27, 2016

(65) Prior Publication Data

US 2017/0182796 A1 Jun. 29, 2017

(30) Foreign Application Priority Data

Dec. 28, 2015 (JP) ..... 2015-256544

(51) Int. Cl.

| | |
|---|---|
| ***B41J 3/60*** | (2006.01) |
| ***B41J 2/01*** | (2006.01) |
| ***B41J 15/04*** | (2006.01) |
| ***B41J 25/00*** | (2006.01) |
| *B41J 3/54* | (2006.01) |

(52) U.S. Cl.

CPC . *B41J 3/60* (2013.01); *B41J 2/01* (2013.01); *B41J 15/048* (2013.01); *B41J 25/001* (2013.01); *B41J 3/543* (2013.01); *B65H 2301/132* (2013.01)

(58) Field of Classification Search

CPC ..... B41J 3/60; B41J 2/01; B41J 13/009; B41J 3/543; B41J 15/048; B41J 25/001; B65H 2301/132; B65H 2301/133

See application file for complete search history.

(56) References Cited

U.S. PATENT DOCUMENTS

2006/0159480 A1* 7/2006 Mima ..... B41J 3/60 399/82

2007/0041049 A1 2/2007 Kojima et al.

FOREIGN PATENT DOCUMENTS

JP 2007-50600 3/2007

* cited by examiner

*Primary Examiner* — Thinh H Nguyen

(74) *Attorney, Agent, or Firm* — Greenblum & Bernstein, PLC

(57) ABSTRACT

A controller in a one-side printing mode moves movable rollers to form a one-side printing route and moves a second head unit so that the second head unit faces a front side of a web. The controller then controls a first head unit and a second head unit to print images of respective pages on the front side of the web while transferring the web at a transfer speed twice as fast as that in a both-side printing mode.

4 Claims, 13 Drawing Sheets

PRINTING DEVICE

CROSS REFERENCE TO RELATED APPLICATION

This application is based upon and claims the benefit of priority from the prior Japanese Patent Application No. 2015-256544, filed on Dec. 28, 2015, the entire contents of which are incorporated herein by reference.

BACKGROUND OF THE INVENTION

1. Field of the Invention

The present invention relates to a printing device for printing images on a web.

2. Description of the Related Art

A printing device that performs both-side printing by continuously transferring a long web and making two individual printing units perform printing on the front side and the back side of the web has been known.

When such a printing device performs one-side printing on the web, only one printing unit is used for printing. This decreases printable-page productivity in one-side printing compared to that in both-side printing.

Patent Literature 1 (Japanese Unexamined Patent Application Publication No. 2007-50600) discloses an image forming system that has two image forming devices to perform one-side printing on each continuous paper (web) and thus maintains the same productivity as that in both-side printing.

The image forming system in Patent Literature 1 has two image forming devices arranged in the shape of the letter L. In both-side printing, continuous paper is wound around a turn bar arranged between the two image forming devices so that the paper is turned over to have its travel direction changed by 90 degrees. This allows a first image forming device to print on the front side of the continuous paper fed by a first continuous paper feeder, which is arranged upstream of the first image forming device, and allows a second image forming device to print on the back side of the continuous paper. The both-side printed continuous paper is cut and stacked at a second after-treatment device arranged downstream of the second image forming device.

In one-side printing, the first image forming device prints images on one side of continuous paper fed by the first continuous paper feeder, and the one-side printed continuous paper is cut and stacked at a first after-treatment device arranged downstream of the first image forming device. The second image forming device prints images on one side of another continuous paper fed by a second continuous paper feeder, and the one-side printed continuous paper is cut and stacked at the second after-treatment device arranged downstream of the second image forming device. This enables the first image forming device and the second image forming device to individually perform one-side printing in parallel to maintain the same productivity as that in both-side printing.

However, since the image forming system in Patent Literature 1 performs printing on one sheet of web (continuous paper) in both-side printing and two sheets of web in one-side printing, a user is required to replace the web sheets when switching between the one-side printing and the both-side printing, which takes much time and labor.

SUMMARY OF THE INVENTION

The present invention is made in view of the above discussion. An object of the present invention is to provide a printing device for printing images on a web that achieves reduction in user's work when switching between both-side printing and one-side printing and prevents a decline in printable-page productivity in one-side printing.

According to a first aspect of the present invention, there is provided a printing device comprising: a first printing unit including a plurality of inkjet heads; a second printing unit including a plurality of inkjet heads; a transfer unit configured to transfer a web along a printing route where the first printing unit faces a first surface of the web and then the second printing unit faces a second surface of the web; a route setting changing unit configured to perform at least one of changing a part of the printing route and moving the second printing unit so that the second printing unit faces the first surface of the web; and a controller configured to control the first printing unit, the second printing unit, the transfer unit and the route setting changing unit, wherein the controller in both-side printing controls the first printing unit to perform printing on the first surface of the web and controls the second printing unit to perform printing on the second surface of the web while controlling the transfer unit to transfer the web along the printing route, and wherein the controller in one-side printing controls the route setting changing unit to have the second printing unit faced to the first surface of the web, and controls the first printing unit and the second printing unit to print images of respective pages on the first surface of the web while controlling the transfer unit to transfer the web at a speed faster than that in the both-side printing.

According to a second aspect of the present invention, the second printing unit is arranged below the first printing unit.

According to a third aspect of the present invention, on the printing route, the web goes in a first travel direction, which is horizontal, and passes under the first printing unit with the first surface thereof facing upward, and then the web goes downward, turns back in a second travel direction, which is horizontal and is opposite to the first travel direction, and passes under the second printing unit with the second surface thereof facing upward. The route setting changing unit comprises: a route changing member configured to push the web, which is in a section where the web goes downward between the first printing unit and the second printing unit on the printing route, in the second travel direction while moving in the second travel direction so as to change a part of the printing route for forming a one-side printing route where a section with the first surface of the web facing upward is added; and a moving unit configured to move the second printing unit. The controller in the one-side printing controls the moving unit to have the second printing unit retreated from a movable range of the route changing member, controls the route changing member to push the web in the second travel direction to form the one-side printing route, and then controls the moving unit to arrange the second printing unit above the web in the added section where the first surface of the web faces upward on the one-side printing route so that the second printing unit faces the first surface of the web.

According to a fourth aspect of the present invention, on the printing route, the web goes in a first travel direction, which is horizontal, and passes under the first printing unit with the first surface thereof facing upward, and then the web goes downward, turns back in a second travel direction, which is horizontal and is opposite to the first travel direction, passes under the second printing unit with the second surface thereof facing upward, thereafter the web moves in the first travel direction with the first surface thereof facing upward again. The route setting changing unit comprises: a moving unit configured to move the second printing unit. The controller in the one-side printing controls the moving unit to arrange the second printing unit above the web, which is in a section where the first surface of the web faces upward again on the printing route, so that the second printing unit faces the first surface.

According to the first aspect of the present invention, in the one-side printing, the first printing unit and the second printing unit respectively print images of respective pages on the first surface of the web, while the web is transferred at a transfer speed faster than that in the both-side printing. This prevents a decline in printable-page productivity in one-side printing. Moreover, the route setting changing unit arranges the second printing unit to face the same surface of the web as that facing the first printing unit. This eliminates user's work of replacing webs in switching between the both-side printing and the one-side printing. As a result, a lot of user's work can be reduced. Therefore, user's work in switching between the both-side printing and the one-side printing is reduced and the decline in printable-page productivity in the one-side printing is prevented.

According to the second aspect of the present invention, the second printing unit is arranged below the first printing unit. This prevents an increase in space of the device.

According to the third aspect of the present invention, the route changing member pushes the web in the second travel direction to change a part of the printing route to form the one-side printing route. Then, the second printing unit is arranged above the web at the added section where the first surface of the web faces upward on the one-side printing route, and thus the second printing unit faces the first surface of the web. This enables the route of the web to be changed with a simpler configuration to make the second printing unit face the same surface of the web as the surface of the web which the first printing unit faces.

According to the fourth aspect of the present invention, in the one-side printing, the moving unit moves the second printing unit to be arranged above the web at the section where the first surface of the web faces upward again on the printing route so that the second printing unit faces the first surface of the web. This enables the second printing unit to face the same surface of the web as that facing the first printing unit without changing the route of the web.

DESCRIPTION OF THE EMBODIMENTS

Figure 1:
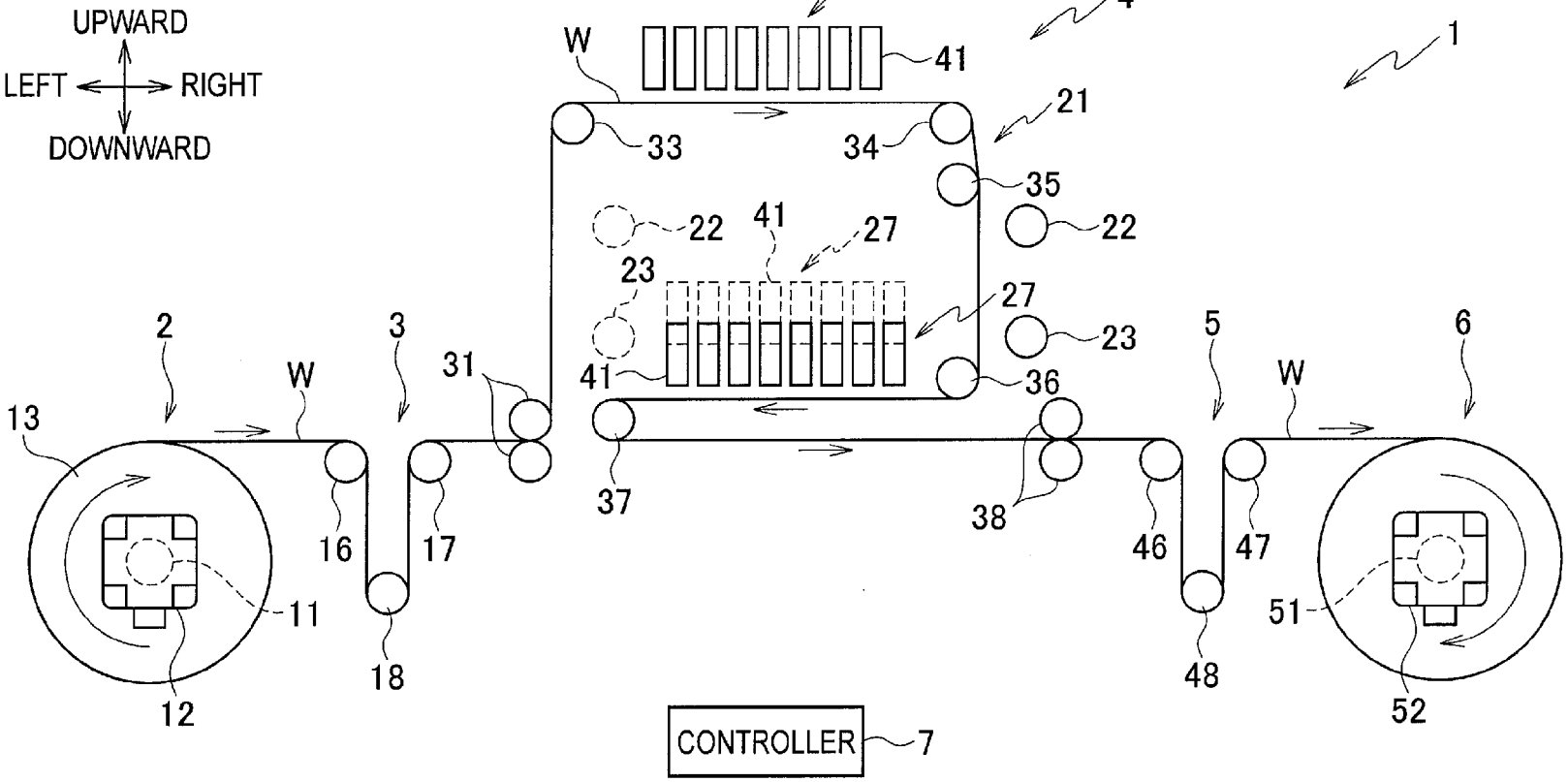
FIG. 1 is a front view showing a schematic configuration of a printing device according to a first embodiment.

The following describes embodiments of the present invention with reference to the drawings. Throughout the drawings, the same or similar parts and components are indicated by the same or similar reference characters.

Embodiments which will be described below exemplify, for example, devices for embodying a technical idea of the present invention. The technical idea of the present invention does not specify characteristics of respective components including materials, shapes, configurations, arrangements and the like to those in the following. Various modifications may be added to the technical idea of the present invention within the scope of the claims.

First Embodiment

Figure 2:
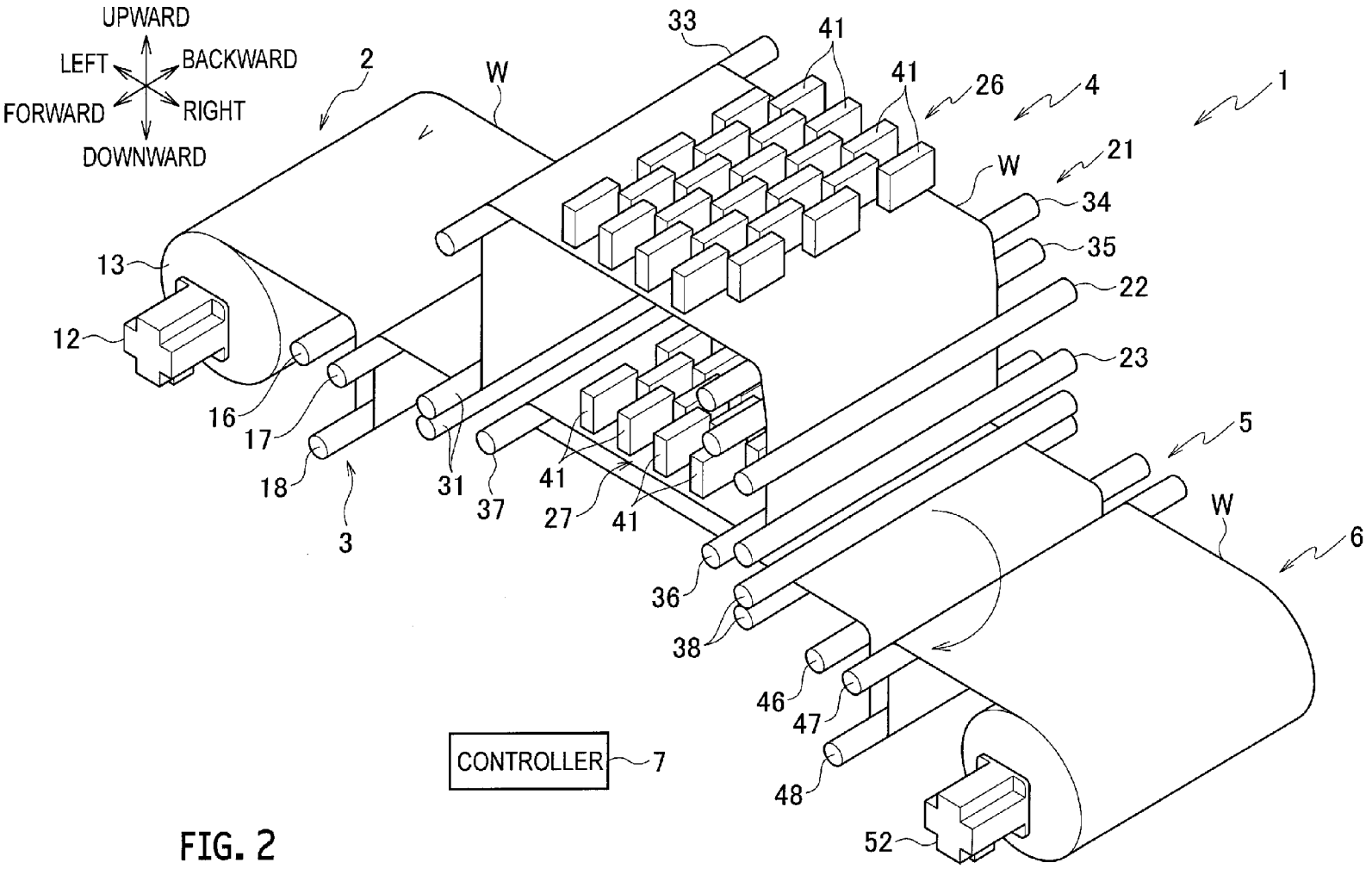
FIG. 2 is a perspective view of the printing device shown in FIG. 1.
Figure 3:
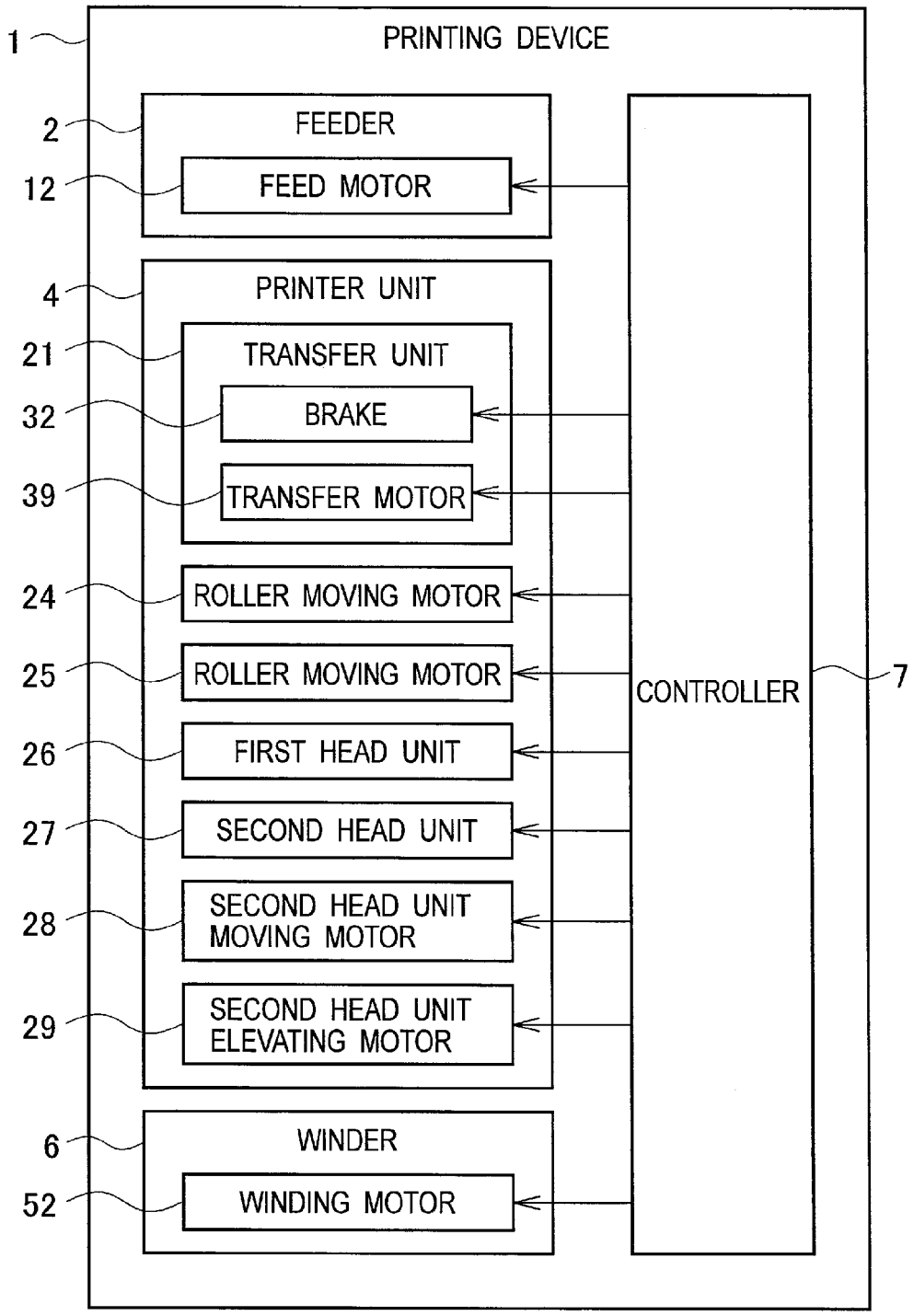
FIG. 3 is a control block diagram of the printing device shown in FIG. 1.

FIG. 1 is a front view showing a schematic configuration of a printing device according to a first embodiment. FIG. 2 is a perspective view of the printing device shown in FIG. 1. FIG. 3 is a control block diagram of the printing device shown in FIG. 1. In the following description, a direction orthogonal to the surface of the paper of FIG. 1 is set as forward and backward directions, where a direction of the front side of the paper is a forward direction. Moreover, a vertical direction of the paper is set as upward and downward directions, and a left-right direction of the paper is set as left and right directions.

As shown in FIGS. 1 to 3, a printing device 1 according to the first embodiment includes a feeder 2, a first buffer 3, a printer unit 4, a second buffer 5, a winder 6, and a controller 7.

The feeder 2 feeds a web W, which is an elongated print medium such as paper or film, to the printer unit 4. The feeder 2 includes a web roll support shaft 11 and a feed motor 12.

The web roll support shaft 11 rotatably supports a web roll 13. The web roll support shaft 11 is formed to be elongated in the forward and backward directions. The web roll 13 is formed by winding the web W.

The feed motor 12 rotates the web roll support shaft 11 clockwise in FIG. 1. The rotation of the web roll support shaft 11 rotates the web roll 13 in the same direction, and the web W is fed downstream (to the right).

The first buffer 3 absorbs slack of the web W between the feeder 2 and the printer unit 4. The first buffer 3 includes support rollers 16, 17, and a dancer roller 18.

The support rollers 16, 17 support the web W between the feeder 2 and the printer unit 4. The support rollers 16, 17 are spaced in the left and right directions and arranged at the same height.

The dancer roller 18 pushes down the web W between the support rollers 16 and 17 by its own weight. This enables the dancer roller 18 to absorb slack of the web W. The dancer roller 18 moves up and down in proportion to the amount of slack of the web W.

The printer unit 4 prints images on the web W while transferring the web W. The printer unit 4 includes a transfer unit 21, movable rollers 22, 23, roller moving motors 24, 25, a first head unit 26, a second head unit 27, a second head unit moving motor 28, and a second head unit elevating motor 29.

The transfer unit 21 transfers the web W fed by the feeder 2. The transfer unit 21 includes a pair of tension applying rollers 31, a brake 32, guide rollers 33 to 37, a pair of transfer rollers 38, and a transfer motor 39.

The pair of tension applying rollers 31 applies tension to the web W. As nipping the web W, the pair of tension applying rollers 31 is driven to rotate by the web W that is transferred by the pair of transfer rollers 38. The brake 32 brakes one of the tension applying rollers 31, and thus tension is given to the web W between the transfer rollers 38 and the tension applying rollers 31.

The brake 32 brakes one of the tension applying rollers 31. The brake 32 is, for example, a powder brake.

The guide rollers 33 to 37 guide the web W between the tension applying rollers 31 and the transfer rollers 38.

The guide roller 33 is arranged above the immediate right of the tension applying rollers 31. The guide roller 34 is arranged at the same height as the guide roller 33 and arranged on the right of the guide roller 33. Between the guide rollers 33 and 34, the web W becomes horizontal and the front side of the web W faces the first head unit 26. In particular, the front side of the web W faces nozzle surfaces (lower surfaces) of inkjet heads 41 of the first head unit 26. The web W moves in the right direction between the guide rollers 33 and 34.

The front side of the web W here is a surface that faces upward when the web W is fed from the web roll 13 by the feeder 2 and is printed earlier in both-side printing.

The guide roller 35 is arranged below and near the guide roller 34. The guide roller 36 is at the same position as the guide roller 35 in the left and right directions, and arranged below the guide roller 35. The guide roller 37 is arranged at the lower left of the guide roller 36.

In a section from the guide roller 34 to the guide roller 37, the web W moves downward and then has its moving direction turned back. That is, the web W moves downward in a section from the guide roller 34 to the guide roller 36, and moves in the left direction in a section from the guide roller 36 to the guide roller 37. Between the guide rollers 36 and 37, the web W becomes horizontal and has its back side faced upward to face the second head unit 27. In particular, the back side of the web W faces nozzle surfaces (lower surfaces) of inkjet heads 41 of the second head unit 27.

The pair of transfer rollers 38 transfers the web W toward the winder 6. The transfer rollers 38 are arranged downstream of the guide roller 37 and transfers the web W while nipping the web W.

The transfer motor 39 rotatably drives the transfer rollers 38.

The movable rollers 22, 23 alter guiding of the web W to change a both-side printing route to a one-side printing route. The movable rollers 22, 23 are configured to be movable between retreat positions indicated by solid lines and route change positions indicated by broken lines in FIG. 1.

The retreat position of the movable roller 22 is at the lower right of the guide roller 35. The retreat position of the movable roller 23 is at the upper right of the guide roller 36. The movable rollers 22, 23 in the retreat positions are apart from the web W, which is between the guide rollers 35 and 36, to the right.

The route change positions of the movable rollers 22, 23 are on the left of the retreat positions over the second head unit 27. By moving from the retreat positions to the route change positions, the movable rollers 22, 23 push the web W, which is between the guide rollers 35 and 36, to the left. This enables the movable rollers 22, 23 to change a part of the both-side printing route to form the one-side printing route.

The both-side printing route is a route for transferring the web W in the both-side printing mode. In particular, the both-side printing route is a route from the guide roller 33 to the guide roller 37 with the movable rollers 22, 23 retreated at the retreat positions.

The one-side printing route is a route for transferring the web W in the one-side printing mode. In particular, the one-side printing route is a route from the guide roller 33 to the guide roller 37 through the movable rollers 22, 23 which are arranged at the route change positions (refer to FIG. 10). On the one-side printing route, the front side of the web W, which is upward between the guide rollers 33 and 34, faces upward again between the movable roller 23 and the guide roller 36. That is, in the one-side printing, a section where the front side of the web W faces upward is added to the both-side printing route. This enables the front side of the web W to face the second head unit 27, and enables also the second head unit 27 to print on the front side of the web W.

The roller moving motors 24, 25 respectively move the movable rollers 22, 23 between the retreat positions and the route change positions.

The first head unit 26 performs printing by discharging ink on the front side of the web W. The first head unit 26 is arranged above the web W between the guide rollers 33 and 34. The first head unit 26 includes a plurality of inkjet heads 41 arranged in a staggered pattern. The inkjet heads 41 open at nozzle surfaces (lower surfaces) and include a plurality of nozzles (not shown) arranged along the forward and backward directions.

In the both-side printing mode, the second head unit 27 performs printing by discharging ink on the back side of the web W between the guide rollers 36 and 37 on the both-side printing route. In the one-side printing mode, the second head unit 27 performs printing by discharging ink on the front side of the web W between the movable roller 23, which is arranged at the route change position on the one-side printing route, and the guide roller 36. The second head unit 27 is arranged below the first head unit 26.

The second head unit 27 is configured to be movable in the forward and backward directions. This enables the second head unit 27 to move between a both-side printing position and a retreat position.

The both-side printing position of the second head unit 27 is a position of the second head unit 27 when printing in the both-side printing mode. In FIG. 1, the both-side printing position of the second head unit 27 viewed from the front is a position of the second head unit 27 indicated by solid lines. The both-side printing position of the second head unit 27 is a position where a head gap (distance between nozzle surfaces of the inkjet heads 41 and the web W) above the web W, which is between the guide rollers 36 and 37 on the both-side printing route, becomes a predetermined value. The retreat position of the second head unit 27 is behind the both-side printing position (see FIG. 6).

The second head unit 27 is configured to be raised and lowered. This enables the second head unit 27 to have its position changed between the both-side printing position and the one-side printing position indicated by broken lines in FIG. 1. The one-side printing position of the second head unit 27 is above the both-side printing positon of the second head unit 27. The one-side printing position of the second head unit 27 is a position where a head gap above the web W, which is in a section from the movable roller 23 to the guide roller 36 on the one-side printing route, becomes a predetermined value. This section is the added section where the front side of the web W is upward again. Note that the movement of the second head unit 27 between the both-side printing position and the one-side printing position is performed through a retreat position, as will be described later.

The second head unit moving motor 28 moves the second head unit 27 in the forward and backward directions.

The second head unit elevating motor 29 raises and lowers the second head unit 27.

The second buffer 5 absorbs slack of the web W between the printer unit 4 and the winder 6. The second buffer 5 includes support rollers 46, 47, and a dancer roller 48.

The support rollers 46, 47 support the web W between the printer unit 4 and the winder 6. The support rollers 46, 47 are spaced in the left and right directions and arranged at the same height.

The dancer roller 48 pushes down the web W between the support rollers 46 and 47 by its own weight. This enables the dancer roller 48 to absorb slack of the web W. The dancer roller 48 moves up and down in proportion to the amount of slack of the web W.

The winder 6 winds the web W printed at the printer unit 4. The winder 6 includes a winding shaft 51 and a winding motor 52.

The winding shaft 51 winds and keeps the web W. The winding shaft 51 is formed to be elongated in the forward and backward directions.

The winding motor 52 rotates the winding shaft 51 clockwise in FIG. 1. The rotation of the winding shaft 51 enables the web W to be wound around the winding shaft 51.

The controller 7 controls operations of respective units of the printing device 1. The controller 7 is configured to include a CPU, an RAM, a ROM, and a hard disk.

The controller 7 performs printing in a printing mode selected from the both-side printing mode and the one-side printing mode. In the both-side printing mode, the controller 7 controls the first head unit 26 to print on the front side of the web W and controls the second head unit 27 to print on the back side of the web W to perform the both-side printing while controlling the transfer unit 21 to transfer the web W along the both-side printing route. In the one-side printing mode, with the second head unit 27 retreated to the retreat position, the controller 7 moves the movable rollers 22, 23 to the route change positions to form the one-side printing route. The controller 7 next arranges the second head unit 27 at the one-side printing position. The controller 7 then controls the first head unit 26 and the second head unit 27 to print images of respective pages on the front side of the web W while transferring the web W at a transfer speed twice as fast as that in the both-side printing mode.

Operations of the printing device 1 will be described below.

First, a printing operation of the printing device 1 in the both-side printing mode will be described.

When determining that a print job is input and the both-side printing mode is specified based on setting information included in the print job, the controller 7 starts transferring the web W. In particular, the controller 7 drives the feed motor 12, the transfer motor 39, the brake 32, and the winding motor 52. This enables the web W to be transferred from the feeder 2 toward the winder 6. At the printer unit 4, the web W is transferred, while the brake 32 brakes one of the tension applying rollers 31 to give the web W tension.

When the printing device 1 is in a waiting state before a print job is input, the movable rollers 22, 23 are arranged at the retreat positions, and the second head unit 27 is arranged at the both-side printing position. In the both-side printing mode, the transfer of the web W is started with this arrangement as it is, and the web W is transferred along the both-side printing route.

When the speed of the web W at the printer unit 4 reaches a predetermined both-side printing transfer speed, the controller 7 controls the feed motor 12, the transfer motor 39, and the winding motor 52 to keep the speed.

Figure 4:
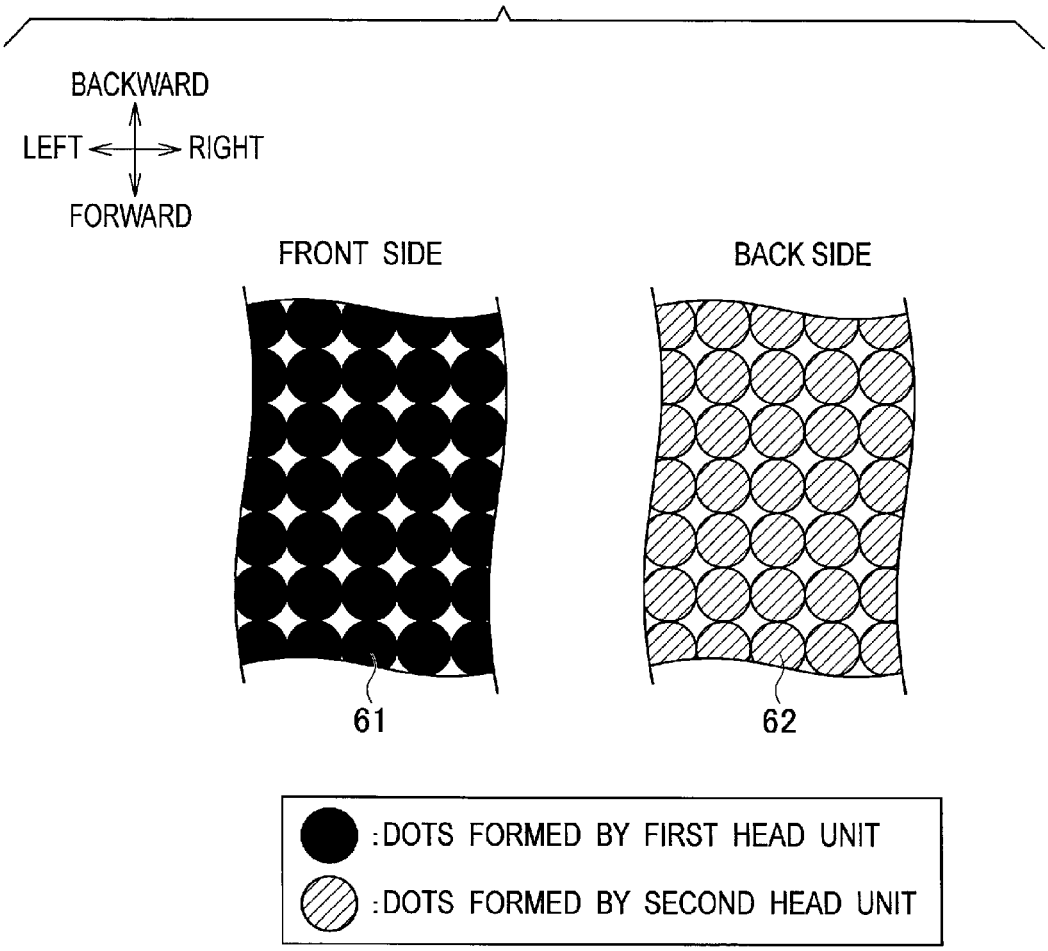
FIG. 4 is a diagram illustrating dot images of respective images printed on the front side and the back side of a web in a both-side printing mode.

Based on the print job, the controller 7 then controls the first head unit 26 to discharge ink on the front side of the web W and controls the second head unit 27 to discharge ink on the back side of the web W. In this way, as shown in FIG. 4, the front side of the web W has an image formed by dots 61 of ink discharged by the first head unit 26, and the back side of the web W has an image formed by dots 62 of ink discharged by the second head unit 27.

When the printing based on the print job ends, the controller 7 stops transferring the web W. In particular, the controller 7 stops the feed motor 12, the transfer motor 39, the brake 32, and the winding motor 52. This ends the printing operation in the both-side printing mode.

Next, a printing operation of the printing device 1 in the one-side printing mode will be described.

Figure 5:
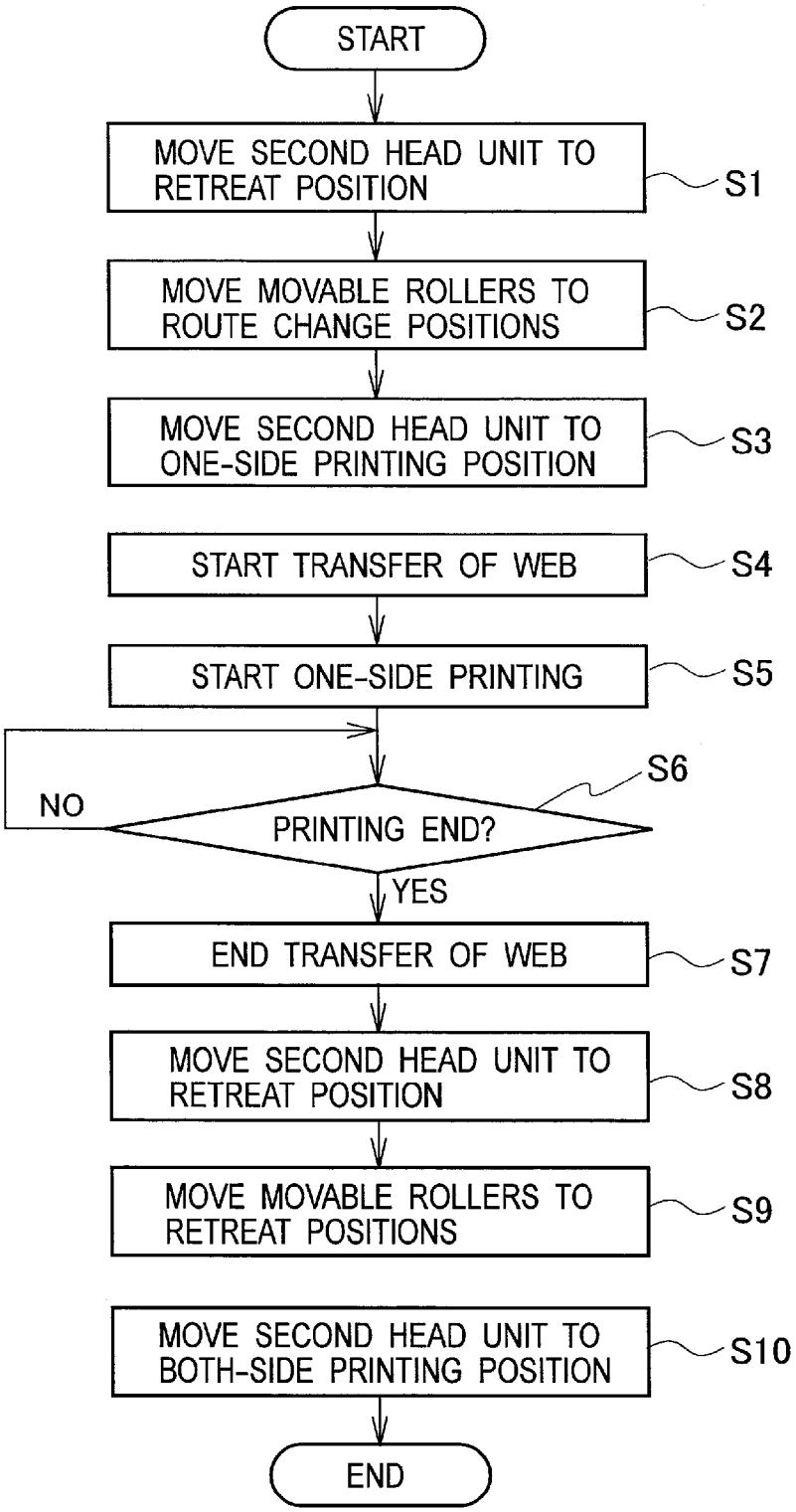
FIG. 5 is a flowchart illustrating a printing operation of the printing device shown in FIG. 1 in a one-side printing mode.

FIG. 5 is a flowchart to describe the printing operation of the printing device 1 in the one-side printing mode. The process in the flowchart in FIG. 5 is started when the controller 7 determines that the one-side printing mode is specified based on setting information included in an input print job.

Figure 6:
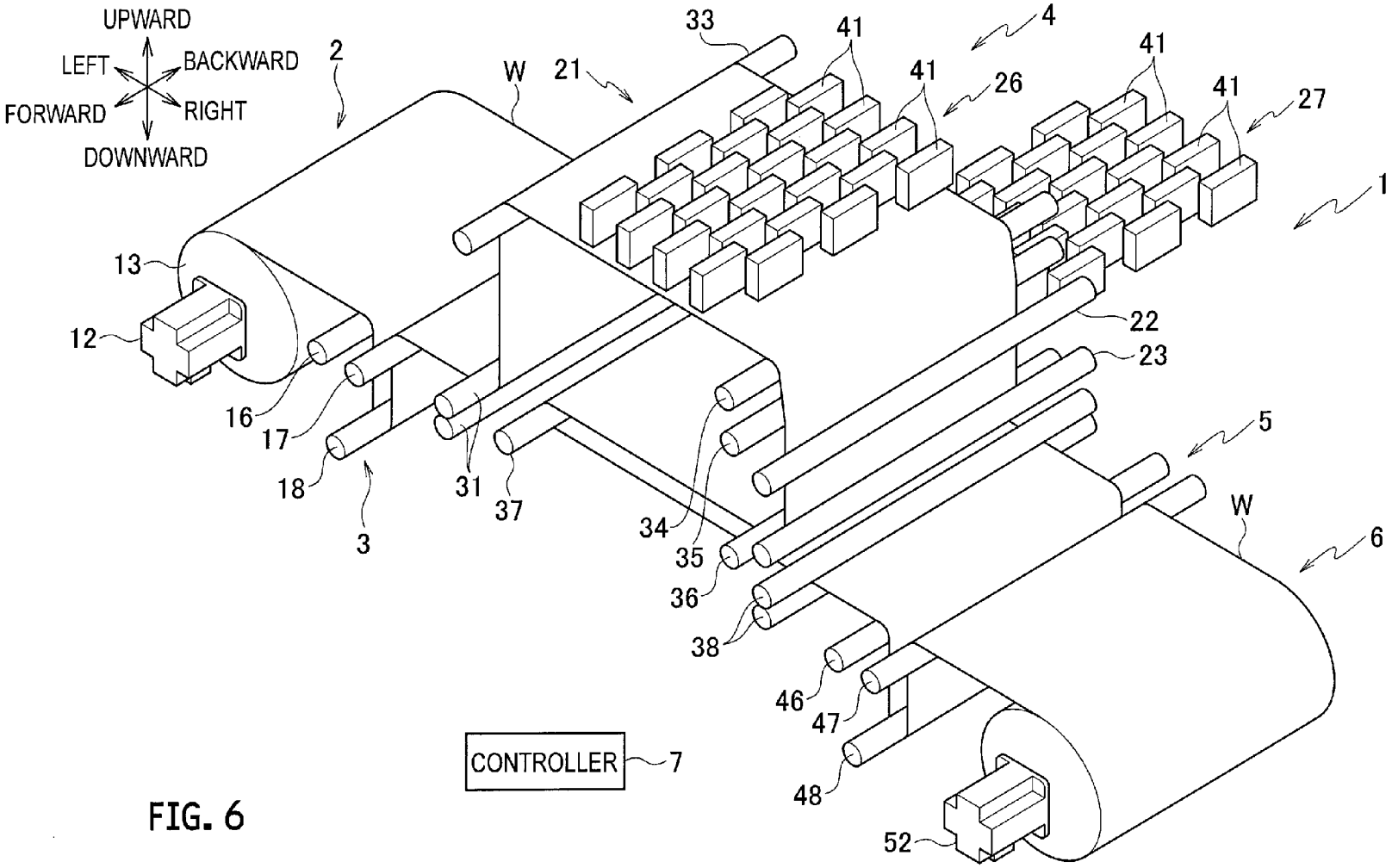
FIG. 6 is a perspective view of the printing device shown in FIG. 1 with a second head unit moved to a retreat position.

In step S1 of FIG. 5, the controller 7 controls the second head unit moving motor 28 to move the second head unit 27 from the both-side printing position to the retreat position as shown in FIG. 6. This ensures the second head unit 27 to retreat from the movable range of the movable rollers 22, 23.

Figure 7:
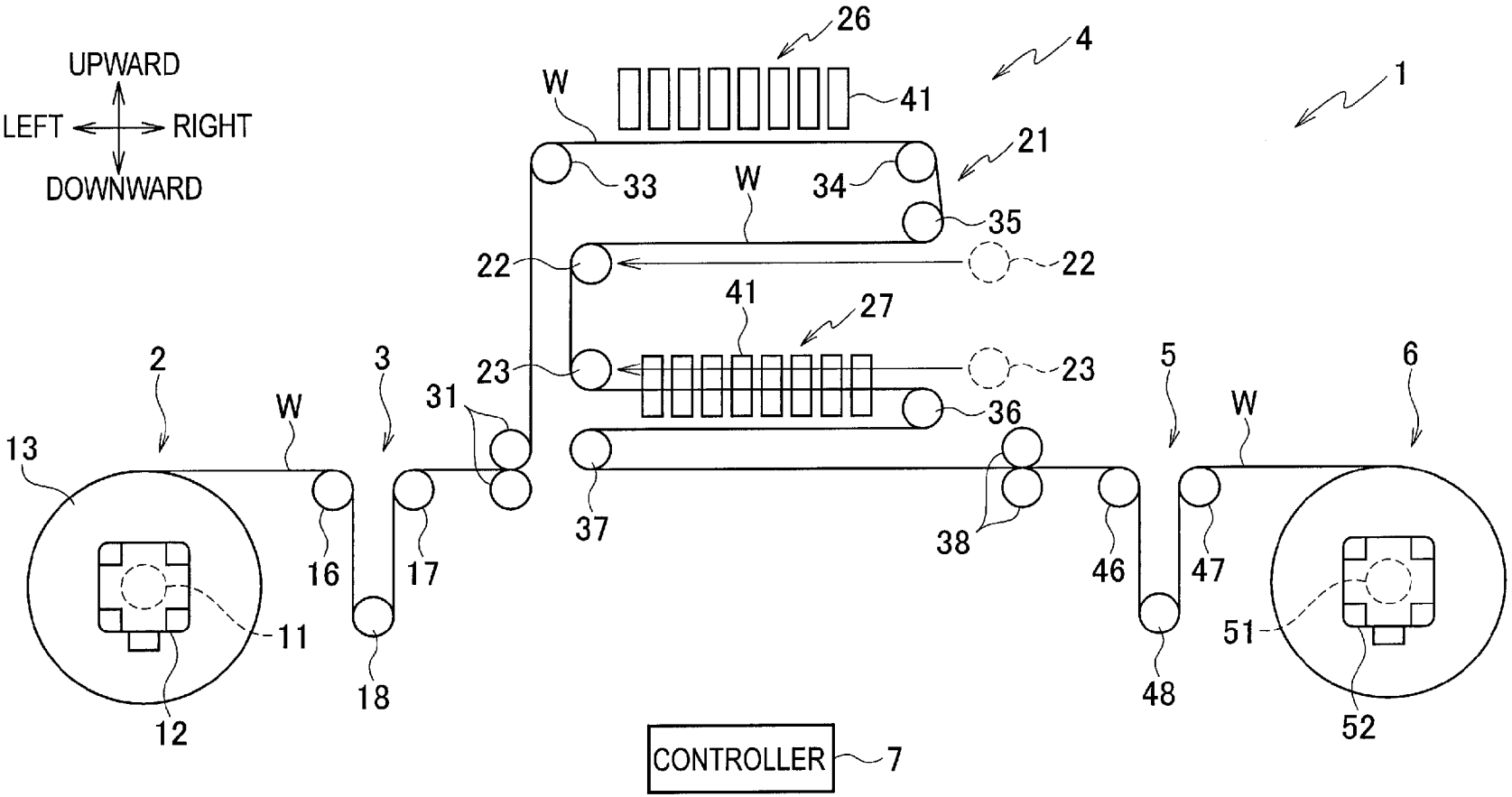
FIG. 7 is a front view of the printing device shown in FIG. 1 illustrating a web route change operation.
Figure 8:
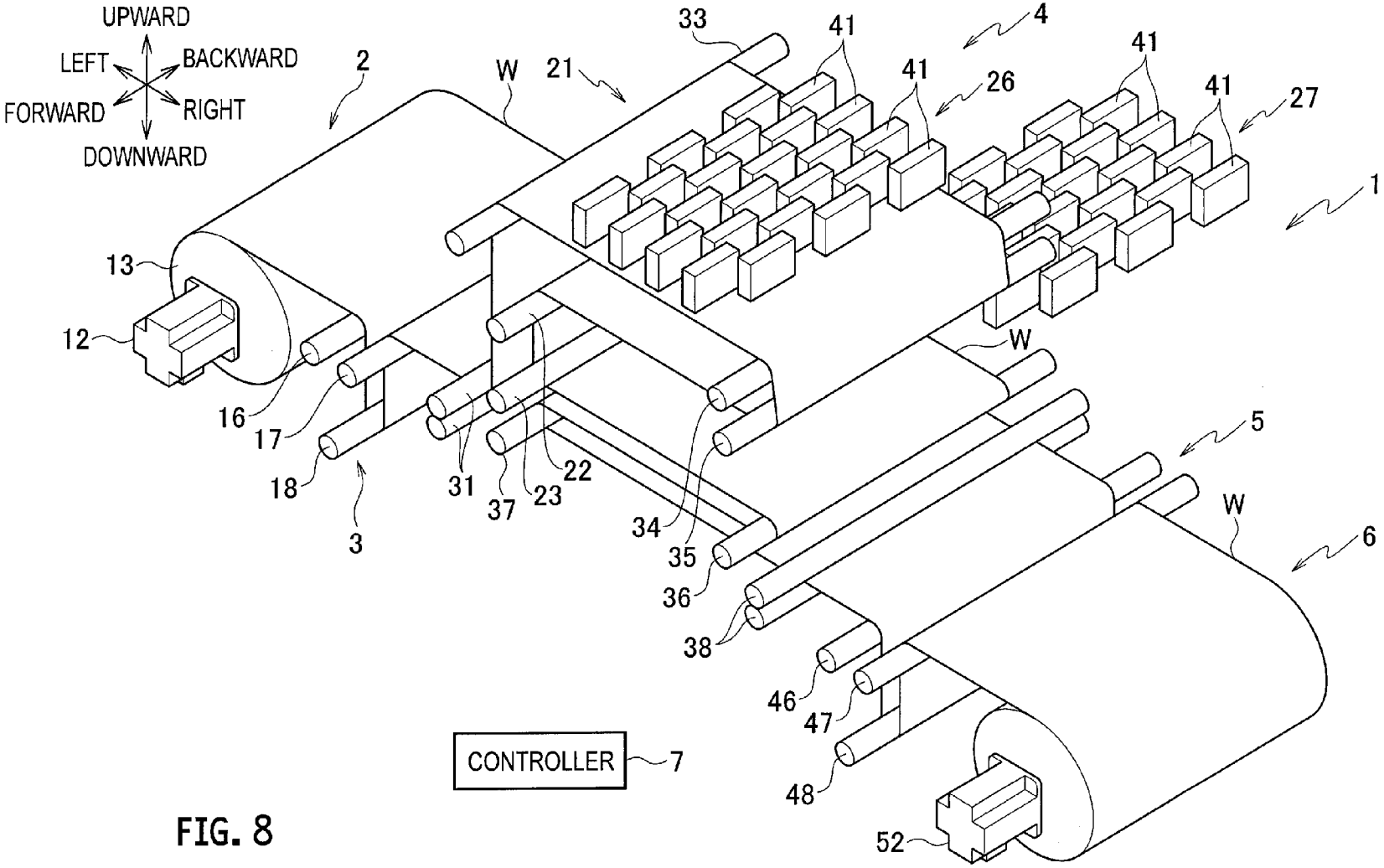
FIG. 8 is a perspective view of the printing device shown in FIG. 1 illustrating the web route change operation.

In step S2 of FIG. 5, the controller 7 controls the roller moving motors 24, 25 to move the movable rollers 22, 23 from the retreat positions to the route change positions. At this time, the controller 7 controls the feed motor 12 to allow the web roller 13 to feed the web W. As shown in FIGS. 7 and 8, this enables the movable rollers 22, 23 to push the web W between the guide rollers 35 and 36 in the left direction to form the one-side printing route.

Figure 9:
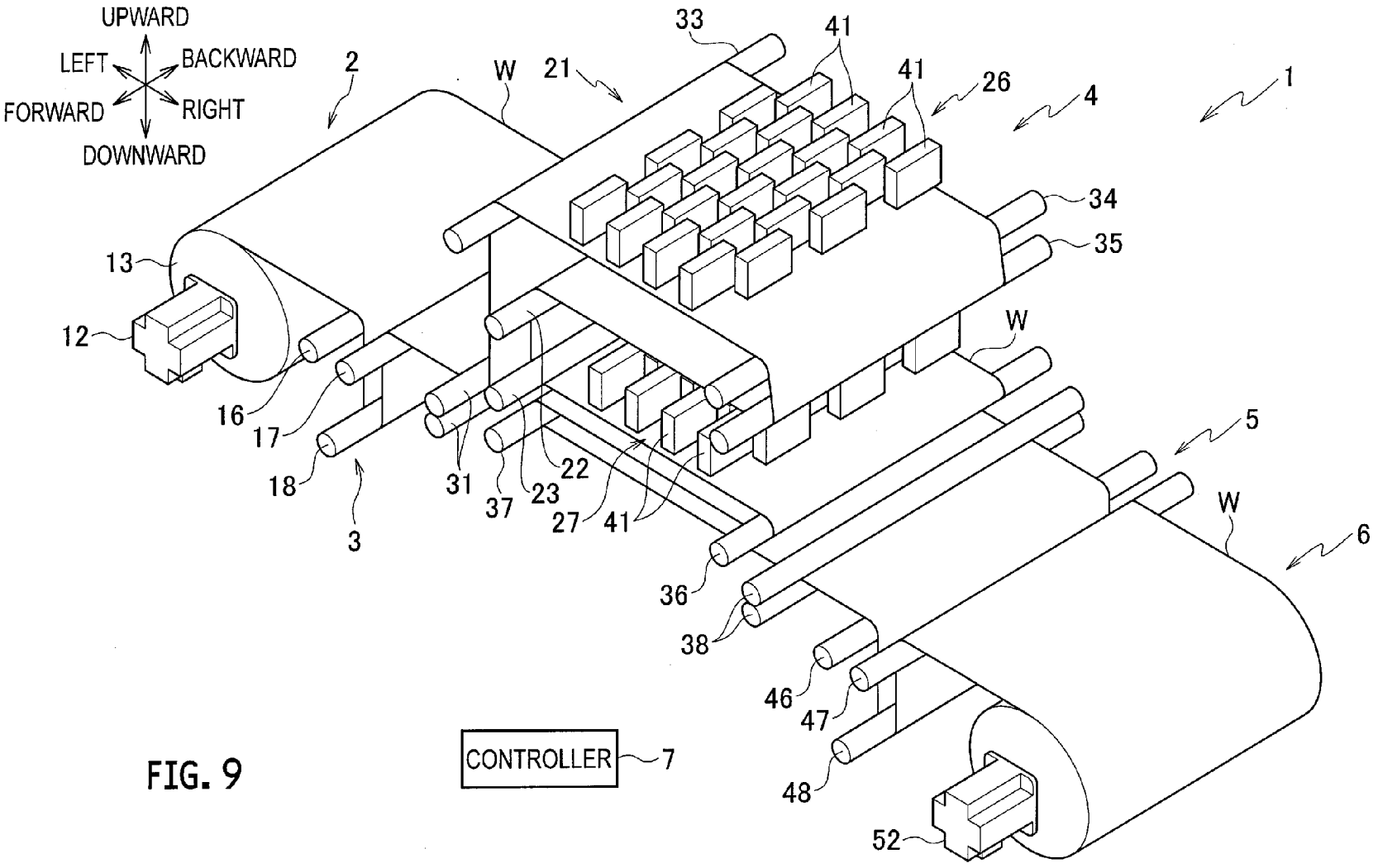
FIG. 9 is a perspective view of the printing device shown in FIG. 1 with a second head unit moved to a one-side printing position.

In step S3 of FIG. 5, the controller 7 moves the second head unit 27 from the retreat position to the one-side printing position. In particular, the controller 7 first controls the second head unit elevating motor 29 to raise the second head unit 27, which is arranged at the retreat position, to the same height as the one-side printing position. The controller 7 then controls the second head unit moving motor 28 to push forward the second head unit 27 to the one-side printing position as shown in FIG. 9.

Figure 10:
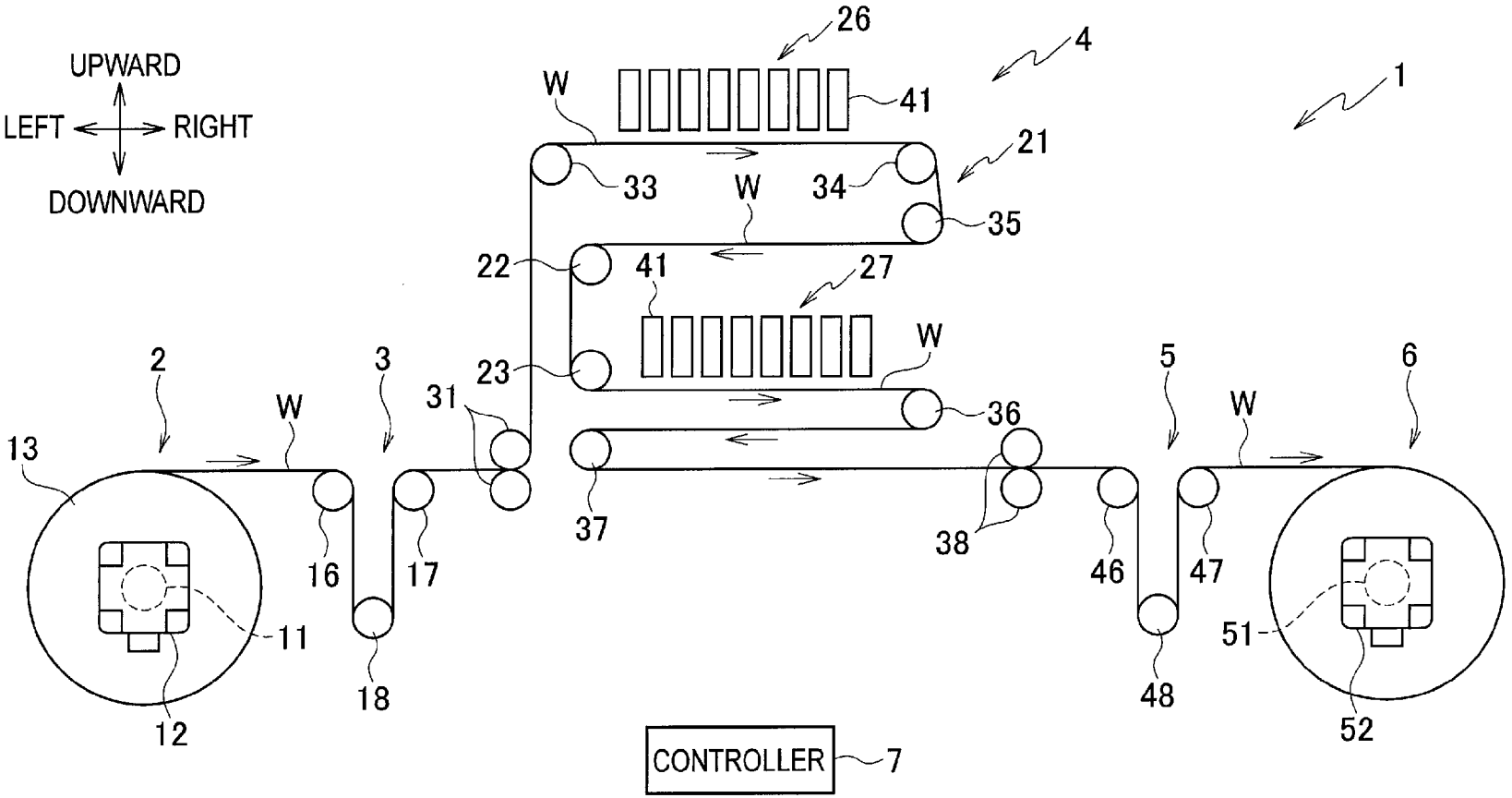
FIG. 10 is a front view of the printing device shown in FIG. 1 when the printing device performs printing in the one-side printing mode.

In step S4 of FIG. 5, the controller 7 starts transferring the web W. In particular, the controller 7 drives the feed motor 12, the transfer motor 39, the brake 32, and the winding motor 52. As shown in FIG. 10, this enables the web W to be transferred from the feeder 2 toward the winder 6. At the printer unit 4, the web W is transferred along the one-side printing route, while the brake 32 brakes one of the tension applying rollers 31 to give the web W tension.

When the speed of the web W at the printer unit 4 reaches a predetermined one-side printing transfer speed, the controller 7 controls the feed motor 12, the transfer motor 39, and the winding motor 52 to keep the speed. The one-side printing transfer speed here is twice as fast as the both-side printing transfer speed.

In step S5 of FIG. 5, the controller 7 starts one-side printing based on the print job. In particular, the controller 7 controls the first head unit 26 and the second head unit 27 to print images of respective pages on the front side of the web W based on the print job.

The controller 7 here controls the first head unit 26 and the second head unit 27 to form images of respective pages alternately line by line along a main scanning direction (forward and backward directions). The first head unit 26 and the second head unit 27 have the same drive frequency (ink discharge cycle) for respective inkjet heads 41 as that in the both-side printing mode.

Figure 11:
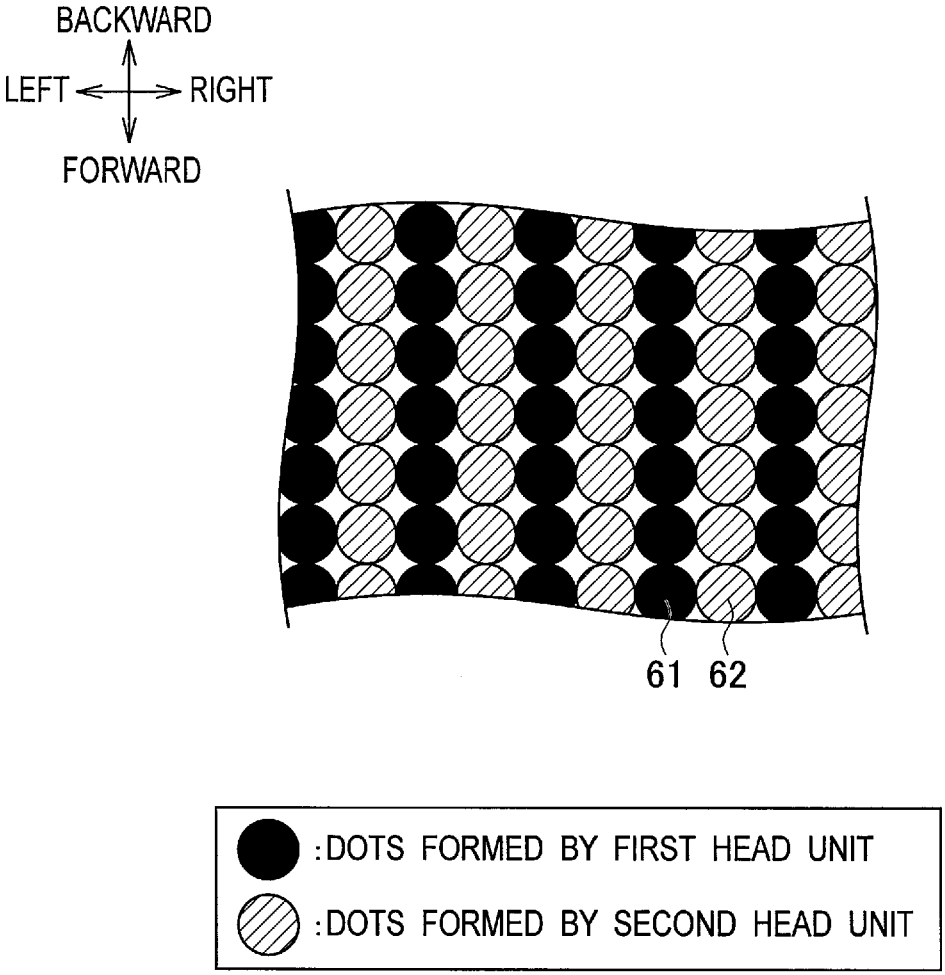
FIG. 11 is a diagram illustrating a dot image of a printed image in the one-side printing mode.

Since the one-side printing transfer speed is twice as fast as the both-side printing transfer speed, with the same drive frequency for the inkjet heads 41 as that in the both-side printing, spaces between lines formed on the web W become two times as wide as those in the both-side printing. As shown in FIG. 11, this ensures spaces between respective lines of dots 61 formed by the first head unit 26 to be complemented by respective lines of dots 62 formed by the second head unit 27 to form an image. In this way, images of respective pages are printed by the first head unit 26 and the second head unit 27.

Back to FIG. 5, after starting the printing in step S5, the controller 7 determines whether the printing based on the print job ends or not in step S6. When the controller 7 determines that the printing does not end (NO in step S6), the controller 7 repeats step S6.

When the controller 7 determines that the printing ends (YES in step S6), the controller 7 in step S7 ends the transfer of the web W. In particular, the controller 7 stops the feed motor 12, the transfer motor 39, the brake 32, and the winding motor 52.

In step S8, the controller 7 moves the second head unit 27 from the one-side printing position to the retreat position. In particular, the controller 7 first controls the second head unit moving motor 28 to move the second head unit 27 back to a position above the retreat position. The controller 7 then controls the second head unit elevating motor 29 to lower the second head unit 27 to the retreat position.

In step S9, the controller 7 controls the roller moving motors 24, 25 to move the movable rollers 22, 23 from the route change positions to the retreat positions. At this time, the controller 7 controls the winding motor 52 to wind an excess of the web W around the wind shaft 51. In this way, the route of the web W is brought back to the both-side printing route.

In step S10, the controller 7 controls the second head unit moving motor 28 to move the second head unit 27 from the retreat position to the both-side printing position. This finishes a series of operations, and the printing device 1 enters the waiting state.

As described above, in the printing device 1 in the one-side printing mode, the controller 7 controls the first head unit 26 and the second head unit 27 to print images of respective pages on the front surface of the web W while transferring the web W at the transfer speed twice as fast as that in the both-side printing mode. This ensures the printable-page productivity in the both-side printing mode to be maintained also in the one-side printing mode.

Moreover, the controller 7 moves the movable rollers 22, 23 to form the one-side printing route, and moves the second head unit 27 so that the second head unit 27 faces the front side of the web W. This eliminates user's work of replacing webs when switching from the both-side printing to the one-side printing, which reduces a lot of user's work.

The printing device 1 therefore reduces work by users in switching from the both-side printing to the one-side printing, and prevents a decline of the printable-page productivity in the one-side printing.

Moreover, the printing device 1 moves the movable rollers 22, 23 as described above to form the one-side printing route. On the one-side printing route, the second head unit 27 is arranged above the web W in the added section where the front side of the web W is upward again, so that the second head unit 27 faces the front side of the web W. This achieves the route change of the web W with a simpler configuration to have the second head unit 27 faced to the front side of the web W that is the same surface facing the first head unit 26.

Moreover, the printing device 1 has the second head unit 27 arranged below the first head unit 26. This prevents an increase in space of the device.

Second Embodiment

Figure 12:
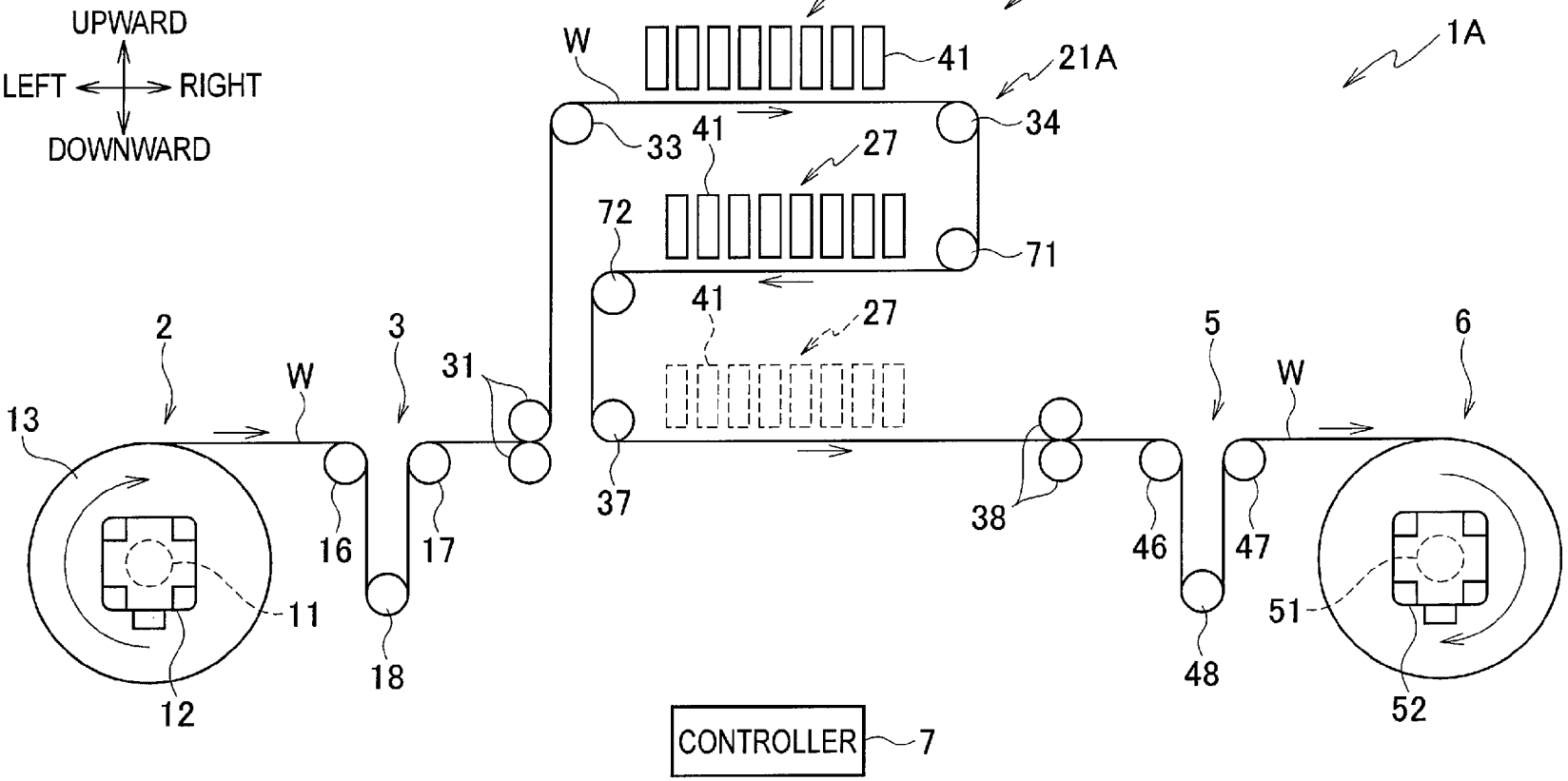
FIG. 12 is a front view showing a schematic configuration of a printing device according to a second embodiment.
Figure 13:
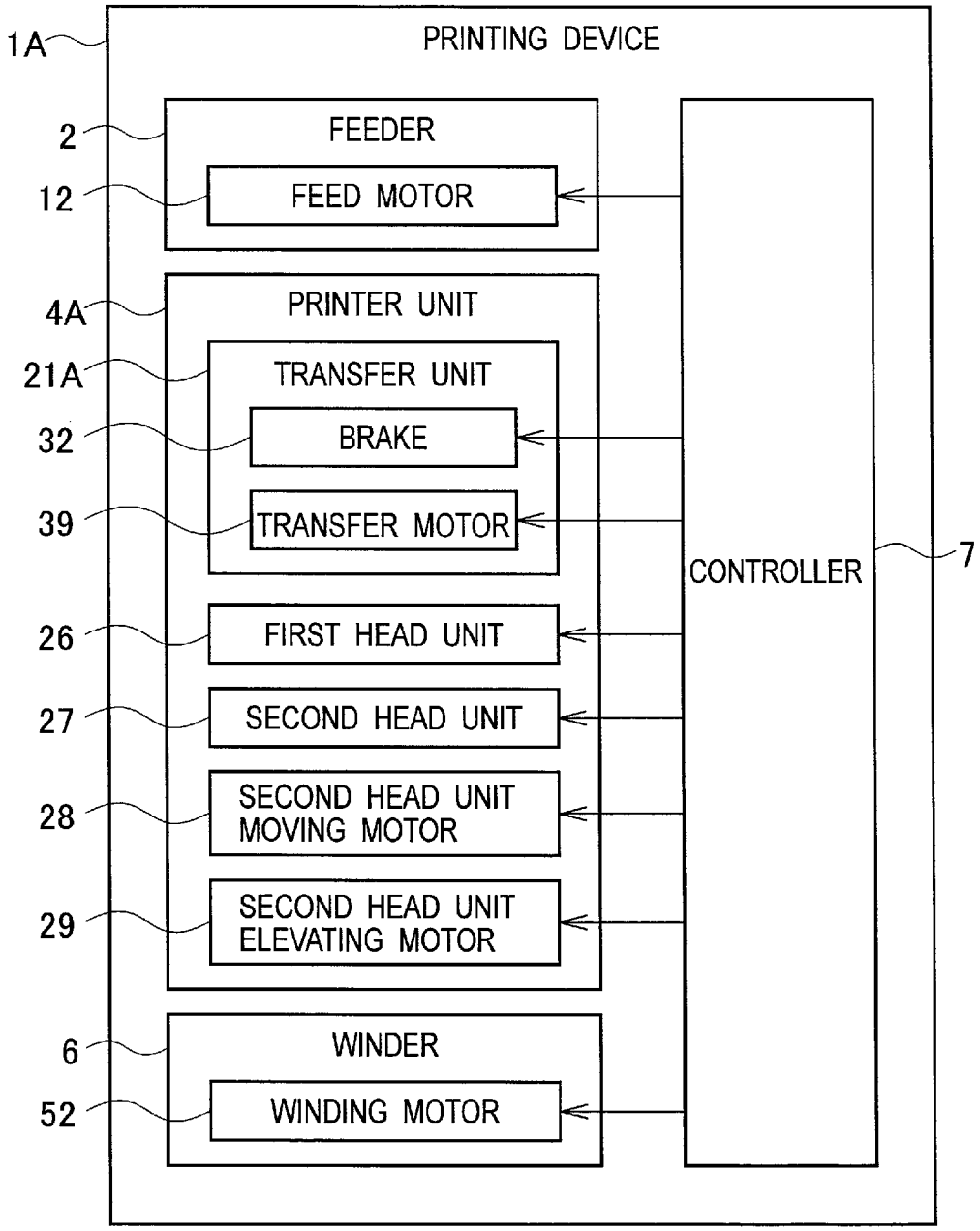
FIG. 13 is a control block diagram of the printing device shown in FIG. 12.

FIG. 12 is a front view showing a schematic configuration of a printing device according to a second embodiment. FIG. 13 is a control block diagram of the printing device shown in FIG. 12.

As shown in FIGS. 12 and 13, a printing device 1A according to the second embodiment includes a printer unit 4A instead of the printer unit 4 of the printing device 1 according to the above-described first embodiment.

The printer unit 4A omits the movable rollers 22, 23 and the roller moving motors 24, 25 of the printer unit 4 according to the above-described first embodiment, and includes a transfer unit 21A instead of the transfer unit 21 of the printer unit 4 according to the above-described first embodiment.

The transfer unit 21A has guide rollers 71, 72 instead of the guide rollers 35, 36 of the transfer unit 21 according to the above-described first embodiment.

The guide roller 71 is arranged below the guide roller 34. The guide roller 72 is arranged at the lower left of the guide roller 71 and above the guide roller 37.

In a section from the guide roller 34 to the guide roller 72, the web W goes downward and has its travel direction turned back. That is, the web W moves downward in a section from the guide roller 34 to the guide roller 71, and then moves to the left in a section from the guide roller 71 to the guide roller 72. The web W becomes horizontal between the guide rollers 71 and 72, and has its back side faced upward to face the second head unit 27 arranged at a both-side printing position. Further, in a section from the guide roller 72 to the transfer rollers 38, the web W goes downward and has its travel direction turned back. That is, the web W moves downward in a section from the guide roller 72 to the guide roller 37, and goes to the right in a section from the guide roller 37 to the transfer rollers 38. The web W becomes horizontal between the guide roller 37 and the transfer rollers 38, and has its front side faced upward again.

The route from the guide roller 33 to the transfer rollers 38 is a printing route at the transfer unit 21A.

In a both-side printing mode, the second head unit 27 is arranged at the both-side printing position, and performs printing by discharging ink on the back side of the web W between the guide rollers 71 and 72. In a one-side printing mode, the second head unit 27 is arranged at a one-side printing position, and performs printing by discharging ink on the front side of the web W between the guide roller 37 and the transfer rollers 38.

The both-side printing position of the second head unit 27 in the printer unit 4A is a position of the second head unit 27 indicated by solid lines in FIG. 12. This position is above the web W between the guide rollers 71 and 72 with a head gap having a predetermined value. The one-side printing position of the second head unit 27 in the printer unit 4A is a position of the second head unit 27 indicated by broken lines in FIG. 12. This position is above the web W between the guide roller 37 and the transfer rollers 38 with a head gap having a predetermined value. A retreat position of the second head unit 27 is behind the both-side printing position.

In the printing in the one-side printing mode, the controller 7 moves the second head unit 27 from the both-side printing position to the one-side printing position, which enables the second head unit 27 to face the front side of the web W. The controller 7 then controls the first head unit 26 and the second head unit 27 to print images of respective pages on the front side of the web W while transferring the web W at a transfer speed twice as fast as that in the both-side printing mode.

Operations of the printing device 1A will be described below.

First, a printing operation of the printing device 1A in the both-side printing mode will be described.

When determining that a print job is input and the both-side printing mode is specified based on setting information included in the print job, the controller 7 drives the feed motor 12, the transfer motor 39, the brake 32, and the winding motor 52. This enables the web W to be transferred from the feeder 2 toward the winder 6. At the printer unit 4A, the web W is transferred along the printing route, while given tension by the brake 32.

The second head unit 27 here is continuously arranged at the both-side printing position since being in a waiting state of the printing device 1A before a print job is input.

When the speed of the web W at the printer unit 4A reaches a predetermined both-side printing speed, the controller 7 controls the feed motor 12, the transfer motor 39, and the winding motor 52 to keep the speed.

Based on the print job, the controller 7 then controls the first head unit 26 to discharge ink on the front side of the web W and controls the second head unit 27 to discharge ink on the back side of the web W.

In this way, as shown in FIG. 4 as with the first embodiment, the front side of the web W has an image formed by dots 61 of ink discharged by the first head unit 26, and the back side of the web W has an image formed by dots 62 of ink discharged by the second head unit 27.

When the printing based on the print job ends, the controller 7 stops the feed motor 12, the transfer motor 39, the brake 32, and the winding motor 52 to end the transfer of the web W. This ends the printing operation in the both-side printing mode.

Next, a printing operation of the printing device 1A in the one-side printing mode will be described.

When the controller 7 determines that a print job is input and that the one-side printing mode is specified based on setting information included in the print job, the controller 7 moves the second head unit 27 from the both-side printing position to the one-side printing position.

In particular, the controller 7 first controls the second head unit moving motor 28 to move the second head unit 27, which is arranged at the both-side printing position, back to the retreat position. The controller 7 then controls the second head unit elevating motor 29 to lower the second head unit 27, which is arranged at the retreat position, to the same height as the one-side printing position. The controller 7 next controls the second head unit moving motor 28 to move forward the second head unit 27 to the one-side printing position.

The controller 7 then drives the feed motor 12, the transfer motor 39, the brake 32, and the winding motor 52. This enables the web W to be transferred from the feeder 2 toward the winder 6.

When the speed of the web W at the printer unit 4A reaches a one-side printing transfer speed, which is twice as fast as a both-side printing transfer speed, the controller 7 controls the feed motor 12, the transfer motor 39, and the winding motor 52 to keep the speed.

Based on the print job, the controller 7 then controls the first head unit 26 and the second head unit 27 to print images of respective pages on the front side of the web W. As with the first embodiment, the controller 7 here controls the first head unit 26 and the second head unit 27 to form images of respective pages alternately line by line along the main running direction (forward and backward directions). The first head unit 26 and the second head unit 27 have the same drive frequency (ink discharge cycle) for respective inkjet heads 41 as that in the both-side printing mode.

In this way, as shown in FIG. 11 as with the first embodiment, spaces between lines of dots 61 formed by the first head unit 26 are complemented by lines of dots 62 formed by the second head unit 27 to form images of respective pages.

When the printing based on the print job ends, the controller 7 stops the feed motor 12, the transfer motor 39, the brake 32, and the winding motor 52 to end the transfer of the web W.

The controller 7 then moves the second head unit 27 from the one-side printing position to the both-side printing position. In particular, the controller 7 first controls the second head unit moving motor 28 to move the second head unit 27 arranged at the one-side printing position back to a position below the retreat position. The controller 7 next controls the second head unit elevating motor 29 to raise the second head unit 27 to the retreat position. The controller 7 then controls the second head unit moving motor 28 to move the second head unit 27 from the retreat position to the both-side printing position. This ends the printing operation in the one-side printing mode.

As described above, in the printing device 1A, the controller 7 in the one-side printing uses the second head unit moving motor 28 and the second head unit elevating motor 29 to move the second head unit 27 from the both-side printing position down to the one-side printing position. That is, the controller 7 in the one-side printing moves and arranges the second head unit 27 above a part of the printing route, where the front surface of the web W is faced upward again, so that the second head unit 27 faces the front surface of the web W. In this way, without changing the route of the web W, the second head unit 27 is made to face the front side of the web W that is the same surface as the surface facing the first head unit 26.

Other Embodiments

As described above, the present invention is described with the first and the second embodiments. However, a description or a figure, which is a part of the disclosure, should not be understood as limiting the invention. The disclosure clarifies various alternative embodiments, examples, and operation techniques for those skilled in the art.

In the above-described first and second embodiments, the one-side printing transfer speed is set twice as fast as the both-side printing transfer speed, but the one-side printing transfer speed is not limited to this speed. The web W may be transferred at a one-side printing transfer speed faster than the both-side printing transfer speed, and the first head unit 26 and the second head unit 27 may be controlled depending on the one-side printing transfer speed to print images of respective pages on the front side of the web W.

In the above-described first and second embodiments, focusing on respective nozzles of the inkjet heads 41 of the second head unit 27 in the left and right directions (left and right directions in FIGS. 1 and 12), the order of discharging in the left and right directions is reversed between in the both-side printing and in the one-side printing. It is as a matter of course to change image proceeding of printing data before starting discharging ink from nozzles of respective inkjet heads 41.

In view of this, the present invention apparently includes various embodiments not described here. The technical scope of the present invention should therefore be determined only by matters identifying the invention within a proper scope of claims from the above descriptions.

What is claimed is:

1. A printing device comprising:

a first printing unit including a plurality of inkjet heads;

a second printing unit including a plurality of inkjet heads;

a transfer unit configured to transfer a web along a printing route where the first printing unit faces a first surface of the web and then the second printing unit faces a second surface of the web;

a route setting changing unit configured to perform at least one of changing a part of the printing route and moving the second printing unit so that the second printing unit faces the first surface of the web; and a controller configured to control the first printing unit, the second printing unit, the transfer unit and the route setting changing unit, wherein the controller in both-side printing controls the first printing unit to perform printing on the first surface of the web and controls the second printing unit to perform printing on the second surface of the web while controlling the transfer unit to transfer the web along the printing route, and wherein the controller in one-side printing controls the route setting changing unit to have the second printing unit faced to the first surface of the web, and controls the first printing unit and the second printing unit to print images of respective pages on the first surface of the web while controlling the transfer unit to transfer the web at a speed faster than that in the both-side printing.

2. The printing device according to claim 1, wherein the second printing unit is arranged below the first printing unit.

3. The printing device according to claim 2, wherein on the printing route, the web goes in a first travel direction, which is horizontal, and passes under the first printing unit with the first surface thereof facing upward, and then the web goes downward, turns back in a second travel direction, which is horizontal and is opposite to the first travel direction, and passes under the second printing unit with the second surface thereof facing upward, wherein the route setting changing unit comprises:

a route changing member configured to push the web, which is in a section where the web goes downward between the first printing unit and the second printing unit on the printing route, in the second travel direction while moving in the second travel direction so as to change a part of the printing route for forming a one-side printing route where a section with the first surface of the web facing upward is added; and a moving unit configured to move the second printing unit, and wherein the controller in the one-side printing controls the moving unit to have the second printing unit retreated from a movable range of the route changing member, controls the route changing member to push the web in the second travel direction to form the one-side printing route, and then controls the moving unit to arrange the second printing unit above the web in the added section where the first surface of the web faces upward on the one-side printing route so that the second printing unit faces the first surface of the web.

4. The printing device according to claim 2, wherein on the printing route, the web goes in a first travel direction, which is horizontal, and passes under the first printing unit with the first surface thereof facing upward, and then the web goes downward, turns back in a second travel direction, which is horizontal and is opposite to the first travel direction, passes under the second printing unit with the second surface thereof facing upward, thereafter the web moves in the first travel direction with the first surface thereof facing upward again, wherein the route setting changing unit comprises:

a moving unit configured to move the second printing unit, and wherein the controller in the one-side printing controls the moving unit to arrange the second printing unit above the web, which is in a section where the first surface of the web faces upward again on the printing route, so that the second printing unit faces the first surface.

* * * * *